US006941782B2

(12) United States Patent
Travis et al.

(10) Patent No.: US 6,941,782 B2
(45) Date of Patent: Sep. 13, 2005

(54) COLD FORGING APPARATUS AND METHOD FOR FORMING COMPLEX ARTICLES

(76) Inventors: Ray Travis, 321 N. Lake Rd., Stevensville, MD (US) 21638; Paul Stone, 2807 Godfrey Rd., Glen Rock, PA (US) 17327

( * ) Notice: Subject to any disclaimer, the term of this patent is extended or adjusted under 35 U.S.C. 154(b) by 0 days.

(21) Appl. No.: 10/291,361

(22) Filed: Nov. 12, 2002

(65) Prior Publication Data

US 2004/0089047 A1 May 13, 2004

(51) Int. Cl.[7] ..... B21J 9/20
(52) U.S. Cl. ..... 72/17.2; 72/21.5; 72/355.6
(58) Field of Search ..... 72/348, 351, 354.6, 72/354.8, 453.02, 17.1, 17.2, 20.4, 20.5, 21.5, 355.6; 100/269.06

(56) References Cited

U.S. PATENT DOCUMENTS 3,184,940 A * 5/1965 Sporck ..... 72/348
3,197,857 A * 8/1965 Nippert ..... 72/354.8
4,299,112 A * 11/1981 Kondo et al. ..... 72/354.8
4,580,431 A * 4/1986 Oku et al. ..... 72/354.8
4,644,775 A * 2/1987 Fuchs, Jr. ..... 72/348
5,031,431 A * 7/1991 Naito ..... 72/21.5
5,471,856 A * 12/1995 Suzuki et al. ..... 72/1
5,823,104 A * 10/1998 Beisel et al. ..... 100/48
6,250,128 B1 6/2001 Ando et al.
6,332,347 B1 12/2001 Gomi

FOREIGN PATENT DOCUMENTS

JP 61-189838 * 8/1986 ..... 72/354.8
JP 5-177291 * 7/1993 ..... 72/355.6

* cited by examiner

*Primary Examiner*—Lowell A. Larson
(74) *Attorney, Agent, or Firm*—Dennison, Schultz, Dougherty & Mac Donald

(57) ABSTRACT

A cold forging apparatus for forming complex shapes at a single station includes a pair of confronting multiple function punch assemblies disposed on a common axis. Each of the multiple function punch assemblies includes an inner or a center punch and an outer or ring-shaped punch surrounding and in sliding contact with the inner punch. The apparatus also includes a die holder for positioning a mass or slug of metal between the punches. A computer system controls movement of the punches and is programmable to form parts of different shapes at a single station.

19 Claims, 6 Drawing Sheets

COLD FORGING APPARATUS AND METHOD FOR FORMING COMPLEX ARTICLES

FIELD OF THE INVENTION

This invention relates to cold forging apparatus and methods for forming complex articles and more particularly to cold forging apparatus for performing multiple functions at a single station and to methods for forming complex metal shapes or articles at a single station.

BACKGROUND FOR THE INVENTION

Cold forging apparatus and processes are well-known. Such apparatus and processes have been used for many years in the commercial production of relatively simple parts at a single station or more complex parts with a multi station set up. However, for more complex parts, the use of a multi station process requires duplication of equipment, additional set-up time, additional space, multiple dies and additional costs. Such costs are particularly excessive for making a limited numbers of forged parts.

More complex parts may also be forged in a machine such as an automatic forging press or cam operated cold header. In such machines, parts are transferred through a variety of stationary die sets, each of which includes a punch. Such machines are capable of operating at high speeds, but are complex, expensive and require considerable set-up time before each run. Accordingly, the use of such machines is generally limited to high volume items where the length of the run justifies the set-up time. The use of such machines is also generally limited to parts which have sufficient complexity and sufficient market value to justify the costs of the machine, set-up time and other operating costs.

It is now believed that there is a commercial market and need for a cold forging apparatus and method for forming complex articles in accordance with the present invention. The reason for such demand is that such apparatus and method offer numerous advantages. For example, the apparatus and method in accordance with the present invention are capable of cold forging complex metal shapes at a single station. Further, the apparatus and methods in accordance with the present invention requires less space and in some cases fewer operators than multiple machines each of which performs a single step in the production of a complex part. The apparatus and methods as disclosed herein also require less set-up time which enables an operator to produce shorter runs at economical costs. This is because fewer stations and less tooling results in lower production costs, particularly in those cases involving smaller volumes of parts.

A further advantage of the apparatus and method of the present invention resides in the use of multiple machines which may be slower than the aforementioned cam operated cold headers, but which provide greater flexibility and backup in the event of a machine failure or down time for a more complex machine. In addition, cold forging apparatus in accordance with the present invention can be produced and sold at a competitive price. For example, it is presently estimated that the cost of a cold forging apparatus in accordance with the present invention is less than 25% of the cost of an automatic cam operated forging press. A still further advantage resides in the use of a computer program in conjunction with multiple sets of punches at a single station. It is also believed that the apparatus in accordance with the present invention will be less complex, less expensive to install, operate and maintain and more reliable than the automatic cam operated cold headers of the prior art. Recognizing, that the prior art automatic cam operated cold headers are capable of relatively fast speeds, it is believed that the use of two, three or more machines in accordance with the present invention will be capable of matching those speeds while providing many of the aforementioned advantages including costs and added flexibility.

BRIEF SUMMARY OF THE INVENTION

In essence the present invention contemplates cold forging apparatus for performing multiple functions or steps at a single station to form a complex metal shape or part. For example, such machines are capable of drawing, upsetting and extruding at a single station using a single die and multiple punches disposed on a common axis. In a preferred embodiment of the invention, the cold forging apparatus includes a first multiple function punch assembly including a first inner punch and a first outer punch movable along a common axis with respect to one another. The apparatus also includes a second confronting multiple function punch assembly including a second inner and a second outer punch movable along a common axis with respect to one another and programmable control means for separately moving the punches individually along the common axes. The apparatus also includes die positioning means for positioning and/or maintaining a die between the first and second multiple function punch assembly and for receiving and containing a mass or slug of metal to be acted on by the punches to thereby form a complex shape.

An important feature of the present invention resides in the use of a multiple ended cylinder to mount and guide the outer punch. It is important to have a multiple ended cylinder with a seal at each end so that a hole or passageway can be formed in the outer cylinder and punch assembly to allow an extension of the inner punch to pass through the center of the outer cylinder and punch. It should also be recognized that the use of a second or more multiple ended cylinders would allow for 3 or more axially nested punches for performing synchronous forming steps inside of a die.

The invention also contemplates a method for forming complex metal shapes at a single station. The method includes the steps of providing nested punch assembly including an inner and an outer punch wherein the outer punch assembly has a double ended rod with a center passageway extending therethrough to thereby form a ring-shaped assembly. The method also includes the step of providing an extension on the inner punch which extends through the center passageway. Further, the method is contemplated by the present invention includes the steps of moving the inner and outer punches along a common axis and into the die and controlling each of the nested punches independently on a work piece within the die.

The invention will now be described in connection with the following figures wherein like reference numerals have been used to designate like parts.

DESCRIPTION OF THE PREFERRED EMBODIMENTS OF THE INVENTION

Figure 1:
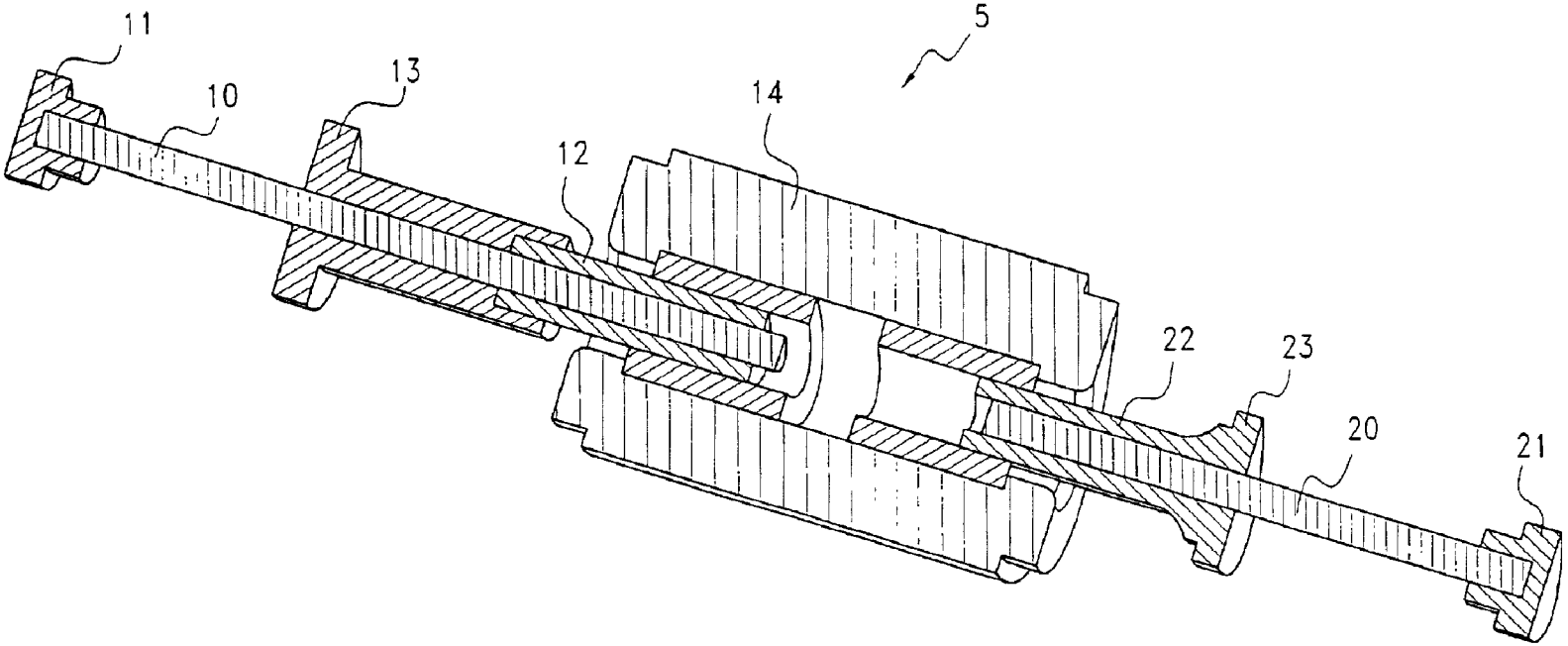
FIG. 1 is a sectional view of confronting coaxial multiple punch assemblies in accordance with a first embodiment of the invention.
Figure 2:
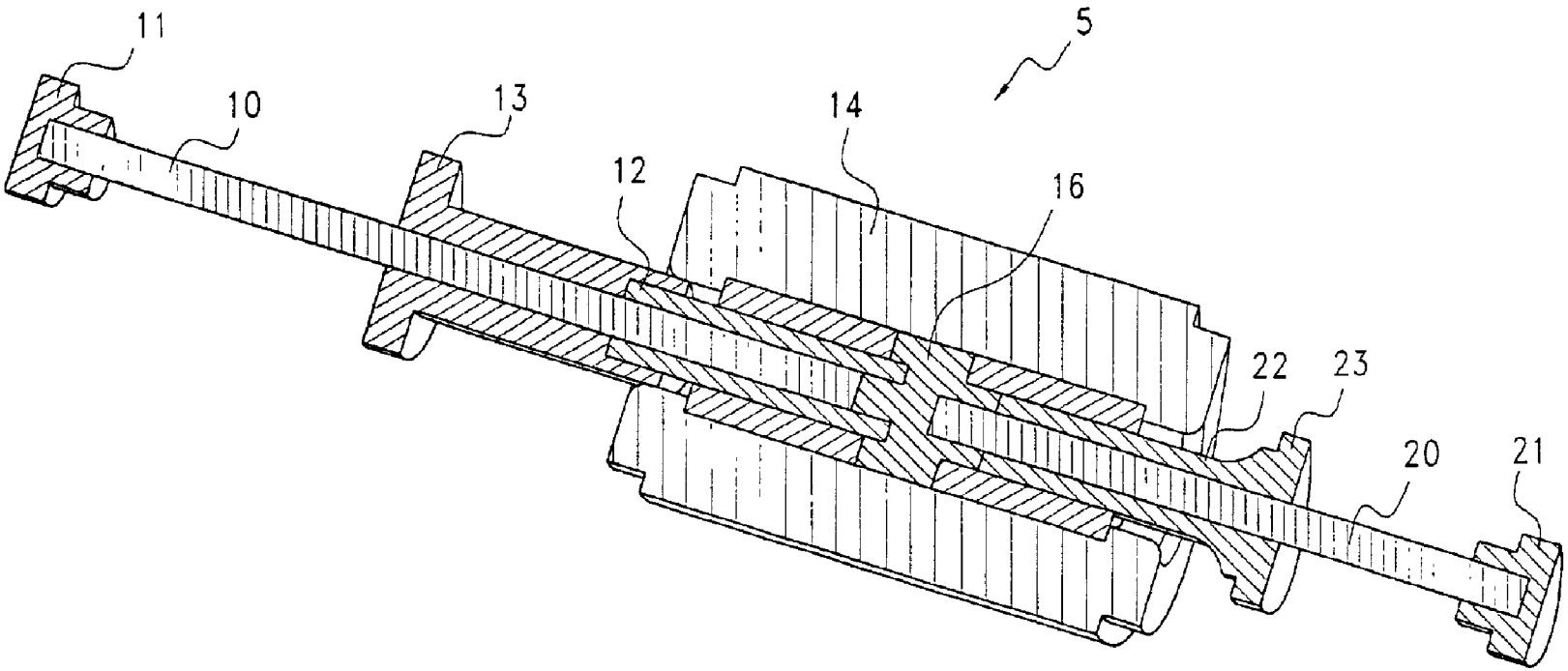
FIG. 2 is a sectional view of the multiple punch assembly as shown in FIG. 1 with the multiple punches in different positions.

FIGS. 1 and 2 illustrate a portion of a cold forging apparatus in accordance with the present invention. As illustrated, a pair of coaxial confronting multiple punch assemblies are constructed and arranged to perform multiple functions or steps at a single station. As shown, a first multiple punch assembly includes a first inner punch 10 and a first outer punch 12 disposed on a common axis in a telescopic relationship so that each of the first inner punch 10 and outer punch 12 are separately controllable and free to move independently along the common axis. The punches 10 and 12 include enlarged end portions or driving elements 11 and 13, respectively, at one end thereof for applying force to each of the punches. The opposite ends of the punches 10 and 12 are shown within a die 14.

The second multiple punch assembly is similar to the first multiple punch assembly and includes a second inner or central punch 20 and a second outer punch 22 disposed on a common axis in a telescoping relationship. The punches 20 and 22 are like the punches 10 and 12 separately controllable and free to move independently along the common axis. The punches 20 and 22 also include enlarged end portions or driving elements 21 and 23, respectively, at one end thereof for applying force to each of the punches. The opposite ends of the punches 20 and 22 are shown within a die 14.

Figure 3A:
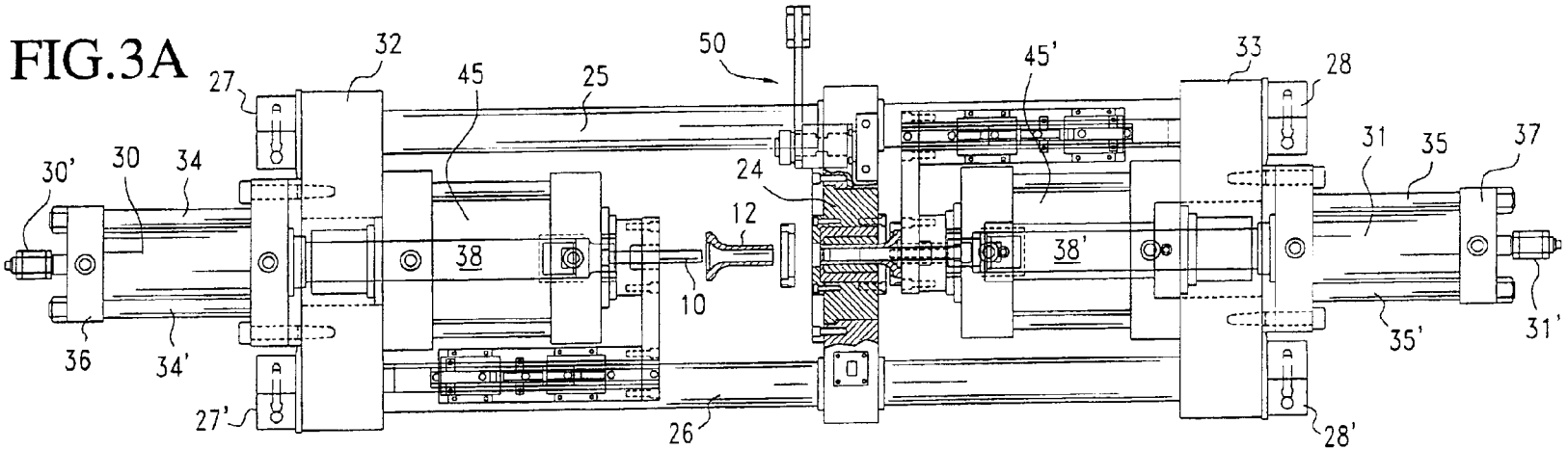
FIG. 3A is a top or plan view of the cold forging apparatus according to one embodiment of the invention.
Figure 3B:
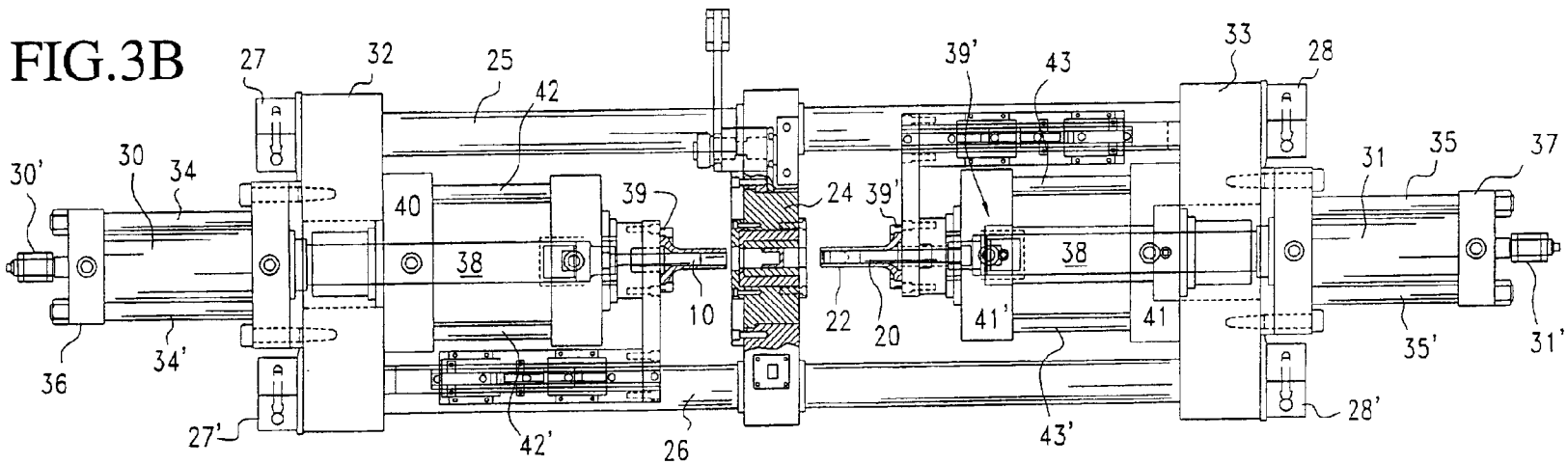
FIG. 3B is a top or plan view of the cold forging apparatus as shown in FIG. 3A with the outer punch fixed to a press and with a forged part within a die.

A cold forging apparatus in accordance with one embodiment of the invention is illustrated in FIGS. 3A and 3B wherein a central platen or die carrier 24 is shown in different positions. The apparatus includes a tie bolt assembly including two bolster plates 32 and 33 which are tied together by four bars or rods 25 and 26 (only two shown) and held together in a conventional manner as indicated by nuts 27, 27', 28 and 28'. A loader/unloader mechanism 50 may also be mounted on the die carrier 24 for automatic or semiautomatic loading of the die 14 by moving a metal slug or blank from a loading area to a position between the punches. A conventional mechanism for loading and/or unloading a blank or part will be described in more detail hereinafter with respect to FIG. 5.

The apparatus also includes hydraulic cylinders 30 and 31 which are outside of the press frame at opposite ends thereof and which are held to the bolster plates 32 and 33 by the bolts 34, 34', 35 and 35', end caps 36 and 37 and a plurality of nuts in a conventional manner. Each of the hydraulic cylinders 30 and 31 is connected to a source of hydraulic pressure (not shown) by connectors 30' and 31'.

The cylinders 30 and 31 drive cylinder rods 38 and 38' along a common axis. The cylinder rods 38 and 38' are connected to the center or inner punch 10 and 20, respectively, by any suitable connectors 39, 39'. The apparatus also includes a pair of cylinders 45, 45' which are disposed within the press frame. These cylinder assemblies include forward and rear end caps 40, 41, forward end caps 40', 41' and tie rods 42, 42', 43 and 43'. The cylinders 45 and 45' are each connected to separate Sources of hydraulic pressure (not shown) in a conventional manner. The cylinders 45, 45' also include a center passageway or hole through which the cylinder rods 38 and 38' pass.

The cylinders 45, 45' each comprise a multi-ended cylinder assembly preferably a double ended rod assembly with a seal at each end and a hole or passageway drilled through the center of the rod. This hole or passageway allows the extension or rods 38 and 38' to pass through the center of the rods. It is also contemplated that a second and third multi-ended cylinder rod could be used to allow for 3 or more axially nested punches for performing synchronous forming steps inside of a die.

Figure 4B:
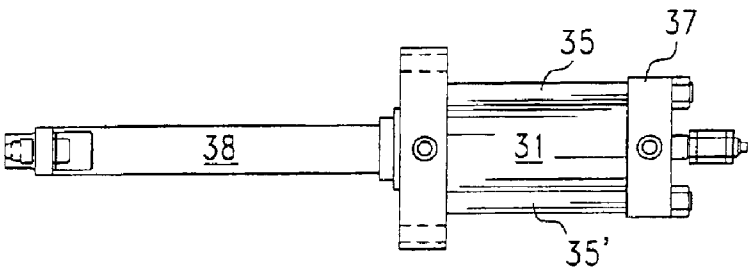
FIG. 4B is a top or plan view of an extended rod for use in practicing the present invention.
Figure 4A:
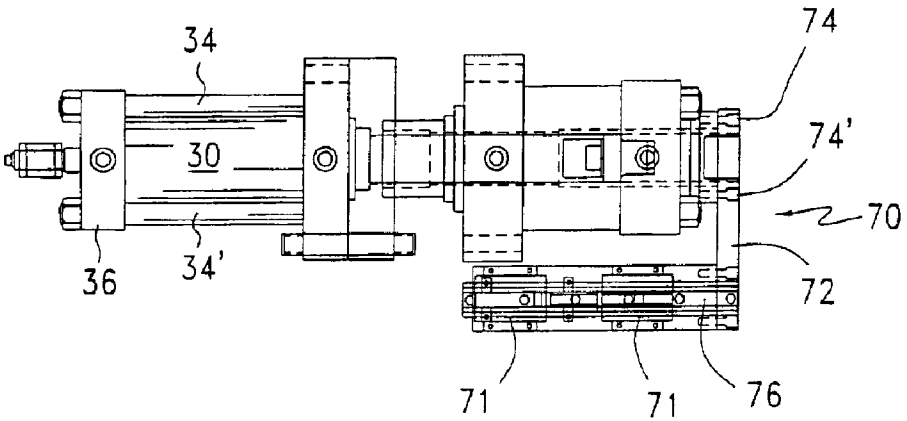
FIG. 4A is a top view of nested hydraulic cylinders of the type used in the cold forging apparatus in accordance with the invention.

The cylinders 30 shown in FIGS. 4A and 4B are of a conventional design. For example, the hydraulic cylinder or presses can be purchased from Miller Fluid Power of Bensenville, Ill. and identified as model H-67B. As shown more clearly in FIG. 4B, an extension rod 38' is operably connected to the cylinder 30 for passing through the cylinder 45'. The cylinder 45' is also of a conventional design, but has been modified by forming a passageway or drilling a hole through the center of the rod to form a tube shaped rod which is internally supported or guided by conventional bronze bearings. The basic cylinder 45 includes a ring-shaped punch. The basic cylinder is available from Miller Fluid Power as a double ended press, Model No. DH 67B.

As shown in FIG. 4A, the apparatus in accordance with the present invention also includes an anti-rotation mechanism 70. The anti-rotation mechanism includes a pair of carriages 71, 71' and arm 72 which is connected to the carriages 71, 71' in a conventional manner at one end thereof. An opposite end 73 of the arm 72 is bolted to the outer or ring-shaped cylinder rod by a pair of bolts 74 and 74'. The carriages 71, 71' move forward and back along a rail 76 with movement of the ring-shaped cylinder rod and prevents the ring-shaped cylinder rod from rotating inside the cylinder. The anti-rotation mechanism is important when the nested punches must be aligned with the die cavity for complex nested profiles, as for example introducing a part with gear teeth or the like.

Figure 5:
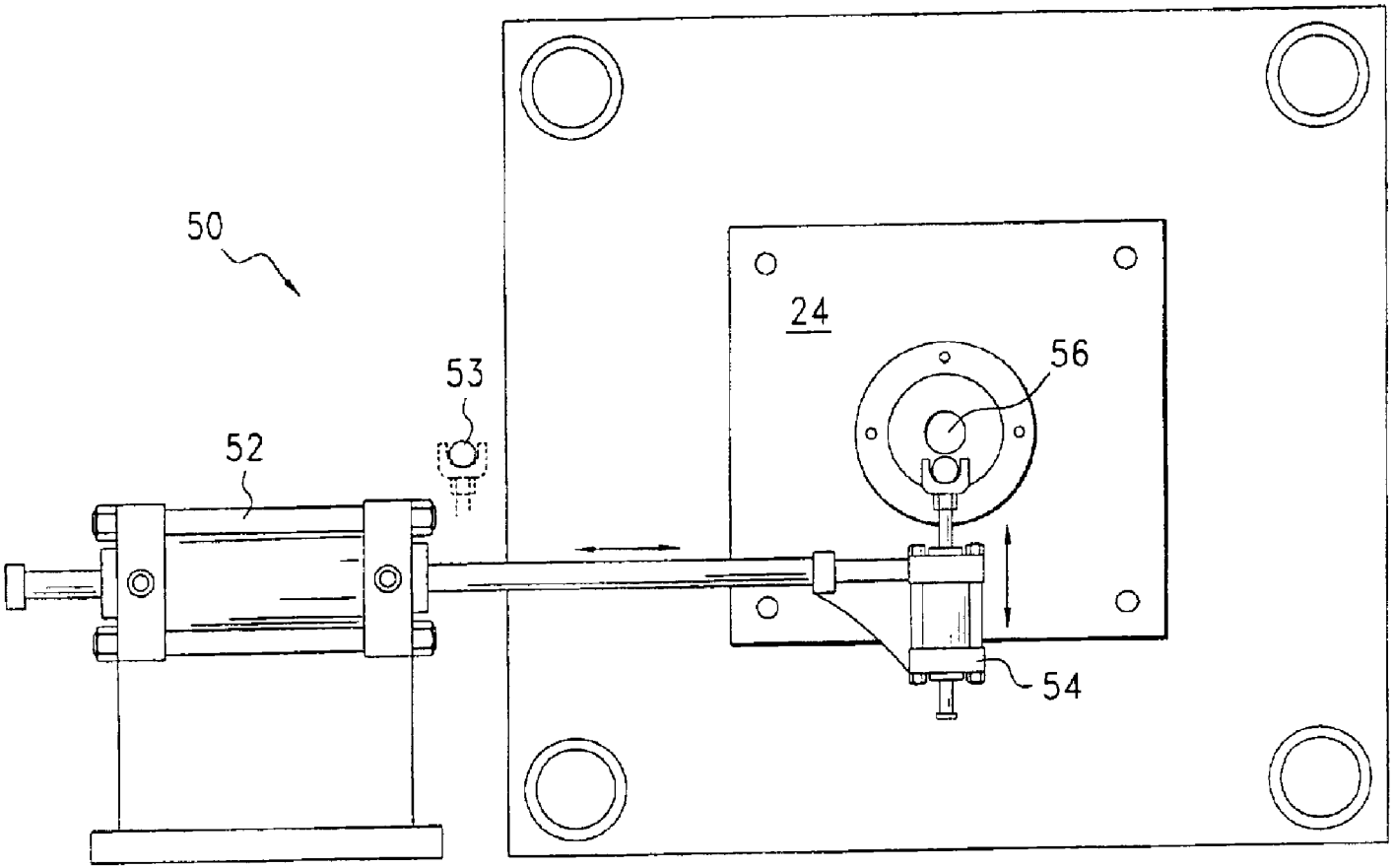
FIG. 5 is a schematic illustration of a conventional loader for use in connection with the present invention.

As illustrated in FIG. 5, a loader 51 may be of a conventional design and may be adjacent to the die carrier 24 or positioned thereon. The loader/unloader 51 includes a pair of air cylinders 52 and 54 for positioning a load blank 53 in front of a die 56. The first cylinder 52 moves a load carrier 55 horizontally from a first position into alignment with the die 56. The second air cylinder 54 then positions the load blank 53 in front of the die where it is delivered into the die 56 by one of the punches. The carrier 55 is then returned to a first position in a conventional manner.

Figure 6:
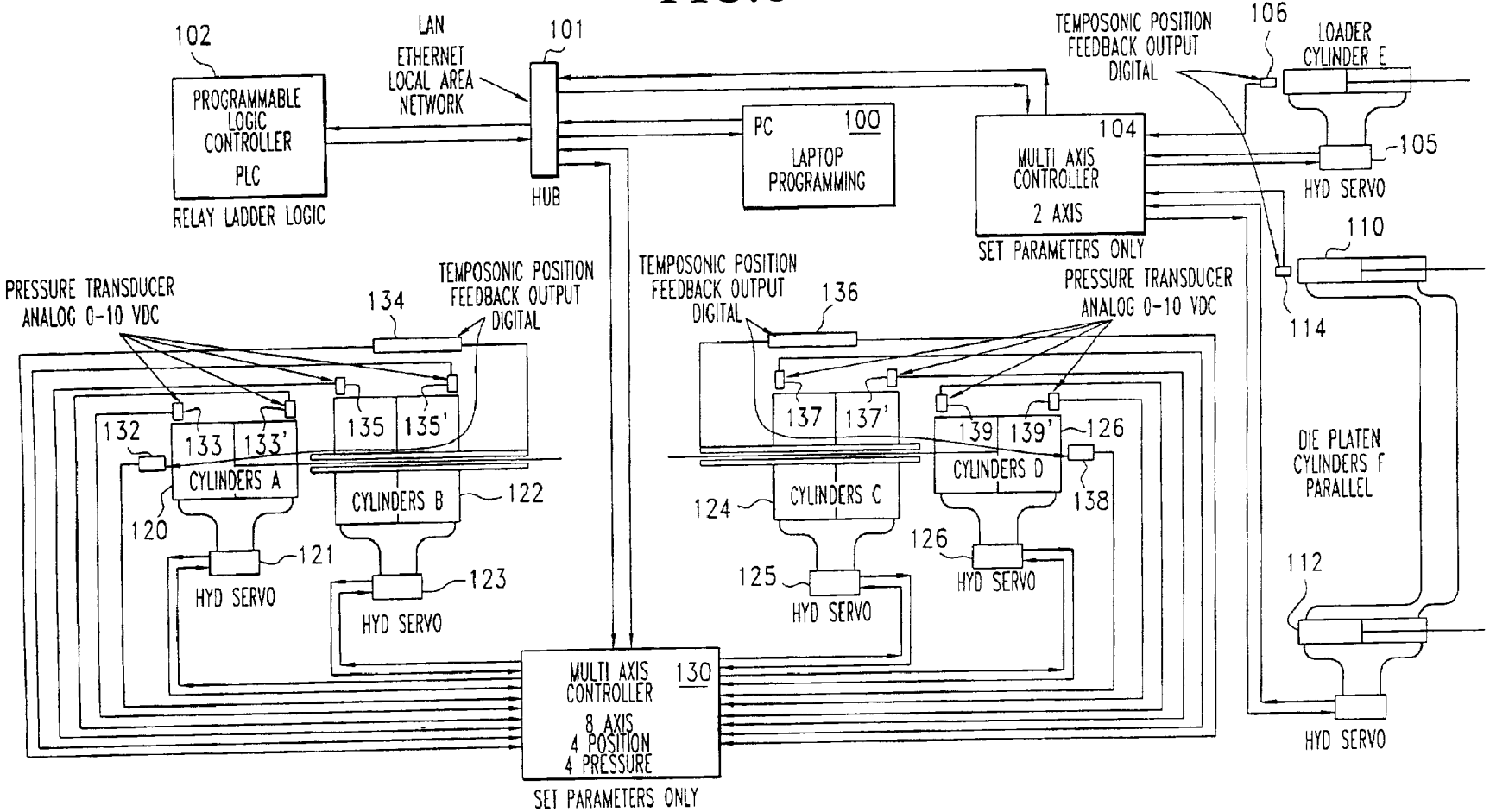
FIG. 6 is a schematic illustration of the control logic for controlling the apparatus in accordance with the present invention.

The operation of the cold forging apparatus disclosed herein is illustrated in FIG. 6. As shown therein, a personal computer 100 such as a laptop is used for programming the programmable logic controller 102 and/or controlling the movement of the punches 10, 12, 20 and 22 (shown in FIGS. 1 and 2) for forming a part having a preselected shape. The computer 100 is operatively connected to a programmable logic control 102 by means of an ethernet local area network (LAN) 101. The LAN 101 is operatively connected to a first multi axis controller 104 which controls a shuttle or other type loader 103. The loader than loads and/or receives a metal slug or a finished part in response to the data from the multi-axis controller. A Tempasonic position feedback output digital device 106 is also operatively connected to multi access controller 104 and feeds back data on the status of the loader 103.

The multi access controller 104 which is operatively connected to a hydraulic servo 108 to control movement of a pair of parallel die platen pistons in die platen cylinders 110 and 112. A second Tempasonic position feedback output device 114 is operably connected to the multi access controller 104 to convey feedback data to the controller 104.

The movement of the four punches 10, 12, 20 and 22 (FIGS. 1 and 2) are actuated by hydraulic cylinders 120, 122, 124 and 126 which are operable by means of hydraulic servos 121, 123, 125 and 127, respectively, in response to data or signals from a second multi access controller 130. The second multi access controller 130 is operably connected to the LAN 101 and is effective in controlling eight parameters i.e., four position and four pressure sensors, one each for each of the punches 10, 12, 20 and 22. The second multi access controller 130 receives data corresponding to the positions of the cylinders or pressures on each of the punches from Tempasonic digital position feedback devices 132, 134, 136 and 138, respectively, and pressure from pressure transducers 133, 135, 137, 138, 133', 135', 137', 138, and 138'. Two pressure transducers are provided for each of the four cylinders with one on each side of the pistons.

The data from the Tempasonic feedback devices 132, 134, 136 and 138, and pressure transducers 133, 135, 137, 139, 133', 135', 137' and 139' is transmitted to the programmable logic controller 102 by means of the LAN 101. The Tempasonic feedback devices and pressure transducers are conventional in design and are available from Miller Fluid Power of Bensenville, Ill.

Programming the movement of each of the punches is effective in producing complex shapes within a single die and also for changing the shapes of the forged parts to be formed. Such programs are well within the skill of a programmer with experience in forging parts based on the diagram as shown in FIG. 6.

While the invention has been described in connection with its preferred embodiment, it should be recognized that changes and modifications may be made therein without departing from the scope of the claims.

What is claimed is:

1. A cold forging apparatus for performing multiple functions at a single station to form complex shapes, said apparatus comprising a first multiple function punch assembly including a first inner punch and a first outer punch movable along a common axis with respect to one another, a second movable punch assembly including a second inner punch and a second outer punch movable along a common axis with respect to one another, means for moving said punches individually along said common axes, and means for positioning a die between said first multiple function punch and said second multiple function punch assemblies for receiving and containing a mass of material therein to be acted upon by said punches, and programmable logic controller, multi axis controller and feedback devices including a position sensor and pressure sensor for each of said punches and means for controlling movement of said punches individually along said common axes in response to the sensed pressure and position of said punches to thereby form a complex shape.

2. A cold forging apparatus for performing multiple functions at a single station to form complex shapes according to claim 1, in which said first and said second multiple function punches are disposed and movable along one common axis.

3. A cold forging apparatus for performing multiple functions at a single station to form complex shapes according to claim 2 which said second inner punch has an irregular cross section and in which said feedback devices for each of said punches are output digital devices.

4. A cold forging apparatus for performing multiple functions at a single station to form complex shapes according to claim 3, which said first and said second outer punches have a circular ring-shaped cross section and which surround said first and second inner punches respectively and in which said outer and said inner punches are in sliding contact with one another.

5. A cold forging apparatus for performing multiple functions at a single station to form complex shapes according to claim 4, which includes means for inserting a metal slug to be acted upon between said first and said second multiple function punch assemblies.

6. A cold forging apparatus for performing multiple functions at a single station to form complex shapes according to claim 3, in which one of said outer punches is adapted to extend over an opposite one of said inner punches.

7. A cold forging apparatus for performing multiple functions at a single station to form complex shapes according to claim 3, in which each of said outer punches is adapted to extend over an opposite one of said inner punches.

8. A cold forging apparatus for performing multiple functions at a single station to form complex shapes according to claim 3, which includes means for inserting a metal slug to be acted upon between said first and said second multiple function punch assemblies.

9. A cold forging apparatus for performing multiple functions at a single station to form complex shapes according to claim 2, which said means for separately moving said punches individually along said common axis includes a programmable logic controller, multi axis controller with feedback devices and software for defining the complex shape.

10. A cold forging apparatus for performing multiple functions at a single station according to claim 1 which includes an anti-rotation mechanism for preventing rotation of one of said outer punches.

11. A cold forging apparatus for performing multiple functions at a single station according to claim 1 which includes an independent anti-rotation mechanism for preventing rotation of one of said outer punches.

12. A cold forging apparatus for performing multiple functions at a single station to form complex shapes, said apparatus comprising a multiple function punch assembly including an inner punch and an outer punch movable along a common axis with respect to one another, said outer punch assembly has a multiple ended cylinder including a seal at each end and a passageway extending through the multiple ended assembly, and an extended rod connected to said inner punch extending through said passageway and programmable logic controller, multi axis controller and feedback devices including a position feedback output digital device and a pressure sensor for each of said punches for controlling movement of said punches individually along said common axes in response to the sensed pressure and position of said punches to thereby form a complex shape.

13. A cold forging apparatus for performing multiple functions at a single station to form complex shapes according to claim 12 which includes an anti-rotation mechanism for preventing rotation of said outer punch.

14. A method for forming complex metal shapes at a single station comprising the steps of:

providing a first multiple function punch assembly including an inner punch and an outer punch;

providing a die;

moving the inner and outer punches along a common axis into and out of the die;

controlling the movement of each of the punches to act independently on a workpiece within the die;

providing a plurality of position sensors;

sensing the position of each of the punches;

providing a plurality of pressure sensors;

sensing the pressure on each of said punches; and providing programmable logic controller, multi axis controller and feedback devices for controlling movement of said punches individually along said common axes using both the plurality of pressure sensors and the plurality of position sensors.

15. A method for forming complex metal shapes at a single station according to claim 14 which includes the step of controlling each of the punches to act simultaneously synchronously or sequentially on a workpiece while preventing rotation of one of the outer punches.

16. A method for forming complex metal shapes at a single station according to claim 14 which includes the step of providing a double-ended cylinder having two ends as an outer rod, forming a seal at each of the two ends and forming a passageway extending through a double-ended rod, and providing an extended rod for the inner punch with the extension passing through the passageway.

17. A method for forming complex metal shapes at a single station according to claim 14 which includes the steps of:

providing a second movable punch assembly including a second inner punch and a second outer punch in a coaxial confronting relationship with the first punch assembly; and controlling the movement of each of the punches in each of the assemblies to act on a workpiece.

18. A method for forming complex metal shapes at a single station according to claim 17 and which includes the steps of:

exerting pressure on a workpiece by one of the punches in each of the multiple punch assemblies and subsequently applying pressure on the workpiece by one of the other punches to thereby form a metal part.

19. A method for forming complex metal shapes at a single station according to claim 14 which includes the step of sensing the pressure on each of the punches.

* * * * *